United States Patent [19]

Bressi

[11] 4,446,810

[45] May 8, 1984

[54] ROTARY INDICATOR

[76] Inventor: Nick Bressi, 4886 Normandy Pl., La Mesa, Calif. 92041

[21] Appl. No.: 476,534

[22] Filed: Mar. 18, 1983

[51] Int. Cl.[3] ..... G09F 9/00; G09F 11/02

[52] U.S. Cl. ..... 116/307; 116/312; 116/315; 40/493

[58] Field of Search ..... 116/299, 303, 305, 306, 116/309, 311–315, 337, DIG. 23; 40/591, 593, 493; 70/63, 161

[56] References Cited

U.S. PATENT DOCUMENTS

| | | | |
|---|---|---|---|
| 610,621 | 9/1898 | Brandell | 40/503 |
| 1,033,058 | 7/1912 | Williams | 40/493 |
| 3,096,409 | 7/1963 | Hubbell et al. | 70/161 |
| 3,236,075 | 2/1966 | Williams | 70/63 |
| 4,055,012 | 10/1977 | Cote | 40/593 |
| 4,086,715 | 5/1978 | Blonigen | 116/315 |

*Primary Examiner*—Charles Frankfort
*Assistant Examiner*—W. Morris Worth
*Attorney, Agent, or Firm*—Charmasson & Holz

[57] ABSTRACT

A dialable indicator comprising a lockable enclosure housing a rotatable drum. The outside surface of the drum is contoured to define a plurality of tag-holding stations. A window in the hinged cover of the enclosure allows viewing of one tag-holding station. The drum is biased by a coil spring against one side of the enclosure which is provided with a restriction against rotation of the drum. The drum must be pushed sideways against the spring before it can be moved to display an alternate tag-holding station. Spare tags can be stored in cavities running longitudinally within the drum. A locking mechanism mounted on the cover provides a restriction against lateral movement of the drum when the cover is closed.

7 Claims, 4 Drawing Figures

ROTARY INDICATOR

BACKGROUND OF THE INVENTION

This invention relates to dials and multiple-message indicators. More specifically, the invention relates to signs designed to display a variety of messages as circumstances require.

For instance, it might be necessary to display the contents of a storage or transportation device used for a variety of products. Tankers used in the transportation of petroleum products are, under certain circumstances, required to display on each container the type of fuel, e.g.: diesel fuel, unleaded, regular, or premium gasoline held therein. Since the same container may be used at various times to hold any one of these products, there is need for a semi-permanent, yet readily changeable, way for displaying the nature of such contents.

SUMMARY OF THE INVENTION

The principal object of this invention is to provide a means for selectably displaying one of a plurality of message-conveying signs.

Another object of this invention is to provide a means for quickly updating the list of selectable signs which can be readily selected on such a means.

Another object of this invention is to provide a means for securing the message-displaying sign so that it can be changed only by an authorized person.

These and other objects are achieved by a dialable indicator in which a plurality of message-carrying tags are mounted on a rotatable drum housed inside a locked enclosure, whereby only one of the tags can be viewed through a window cut in the cover of the enclosure.

DESCRIPTION OF THE PREFERRED EMBODIMENT OF THE INVENTION

Figure 1:
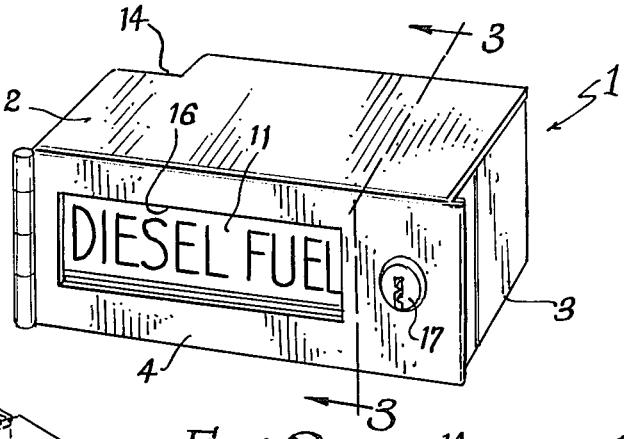
FIG. 1 is a perspective view of the indicator shown in the closed position.
Figure 2:
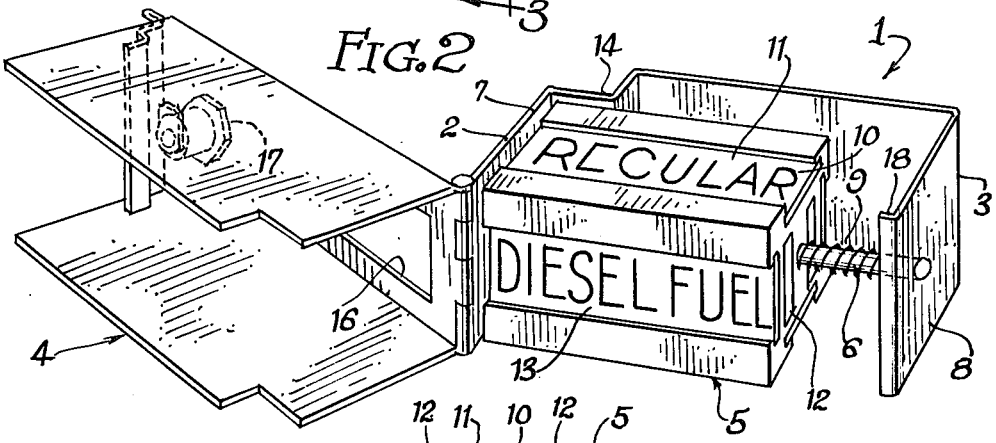
FIG. 2 is a perspective view of the indicator shown with the cover in the open position.
Figure 3:
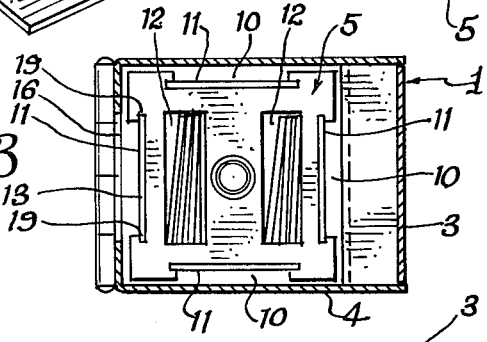
FIG. 3 is a cross-sectional view of the indicator taken along line 3—3 of FIG. 1.

Referring now to the drawing, there is shown a rotary indicator 1 which is housed in a lockable enclosure 2. The enclosure comprises a back frame 3 and a hinged cover 4 which wraps around the top, front and bottom of the indicator. A drum 5 is rotatably mounted on a transversal shaft 6 which spans the full width of the frame 3 from the left-sidewall 7 to the right-sidewall 8. The drum 5 can slide laterally on the shaft 6, but is biased against the left-sidewall 7 by a coil spring 9 engaged over the shaft 6 between the right side of the drum 5 and the inside surface of the right-sidewall 8 of the frame.

The periphery of the drum 5 is polygonal, and in this particular embodiment defines four sides. The surface of each side is shaped and dimensioned to define a tag-holding station in which one of a plurality of message-carrying tags 11 can be inserted. In this embodiment four tags can be mounted on the drum 5; the edges of the tag being engaged into the two parallel grooves 19 of each station. A plurality of others can be stored within two cavities running transversally on each side of the shaft within the drum itself. Tags can be inserted from right to left in the front-facing station; the width of the right-sidewall 8 being short enough to provide access to the front-facing station and alternately to each of the cavities 12.

Figure 4:
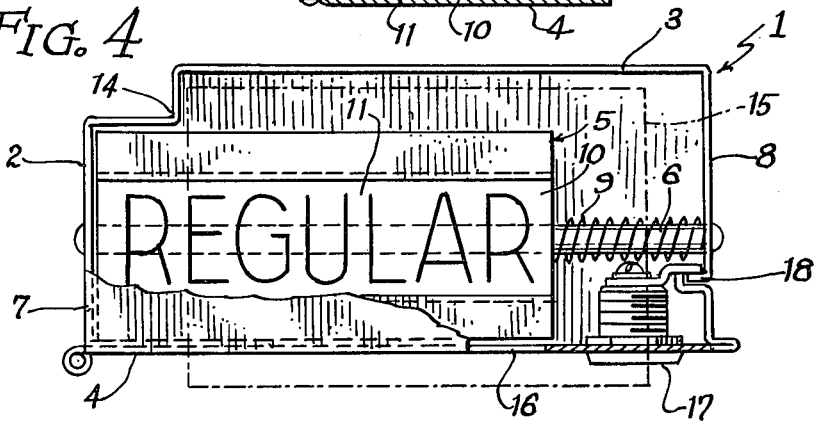
FIG. 4 is a top plan view of the indicator in which a portion of the top cover has been cut away to show the internal structure.

The back frame 3 has an indentation in the back left corner which prevents rotation of the drum 5 in its normal position. The drum, however, can be rotated after it has been manually shifted to the right, against the spring 9. Broken line 15 of FIG. 4 delineates the space occupied by the drum 5 in the course of its rotational movement. Each tag 11 carries a sign or message. In this embodiment each tag is engraved with a particular type of petroleum product. This type of indicator would be installed on or in the proximity of a container which at various times may be holding any one of these various types of petroleum products.

The cover 4 is designed to provide a means for securing the indicator and preventing changes by unauthorized persons. The cover 4 is hinged on the front end of the left-sidewall 7. A window 16 is cut in the front face facing the area occupied by the front station 13. A keyed lock mechanism 17 is used to secure the cover 4 to a flange 18 at the front-end of the right-sidewall 8. The lock mechanism being nested close to the right side of the drum 5 prevents manipulation of the drum by an unauthorized person through the front panel window 16.

The preferred embodiment described herein can be installed by bolting the back face of the frame 3 to the container. The window could be alternately cut into the front, top or bottom panel of the cover 4.

While the preferred embodiment of the invention has been described and modifications thereto have been suggested, other indicators could be devised and other changes could be made without departing from the spirit of the invention and the scope of the appended claims.

What is claimed is:

1. A rotary indicator which comprises:

a mounting frame;

a drum having a plurality of peripheral message-holding stations;

means for rotatably mounting said drum within said frame;

said means for rotatably mounting comprising:

a shaft axially and slidingly engaging a hole in the center of said drum;

said shaft being supported at each end by elements of said frame;

releasable means for preventing rotational movement of said drum within said frame;

said means for preventing comprising one of said elements defining a spacial restriction; and resilient means for biasing said drum toward said spacial restriction;

at least one message display mountable in said stations;

and comprising an oblong tag carrying a message on at least one of its faces;

each of said message-holding station comprising means for securing said tag; and wherein said frame comprises a backwall and first and second sidewalls supporting said shaft; and said spacial restriction is defined by an inward indentation at the juncture of said backwall and of first said sidewall.

2. The indicator claimed in claim 1 which further comprises releasable means for blocking the movement of said drum out of said spacial restriction.

3. The indicator claimed in claim 2 wherein said means for blocking comprises:

a cover spanning the sidewalls of the frame; and a projection in said cover extending between said drum and the second wall when said cover is closed.

4. The indicator claimed in claim 3 wherein said projection comprises a locked mechanism having a bolt engageable into said second wall.

5. The indicator claimed in claim 2 wherein said drum has at least one cavity shaped and dimensioned to hold at least one spare tag.

6. The indicator claimed in claim 2 wherein said means for securing said tag comprises two parallel-spaced, grooved projections shaped and dimensioned to hold the edges of a tag.

7. The indicator claimed in claim 2 wherein said means for biasing said drum comprise a coil spring engaged over said shaft and compressed between said drum and said second wall.

* * * * *